US010847923B1

(12) United States Patent
Lin

(10) Patent No.: US 10,847,923 B1
(45) Date of Patent: Nov. 24, 2020

(54) OUTDOOR WATERPROOF POWER SOCKET

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 16/597,168

(22) Filed: Oct. 9, 2019

(51) Int. Cl.

| | |
|---|---|
| ***H01R 13/52*** | (2006.01) |
| ***H01R 24/78*** | (2011.01) |
| ***H01R 13/514*** | (2006.01) |
| *H01R 103/00* | (2006.01) |

(52) U.S. Cl.
CPC ..... *H01R 13/5202* (2013.01); *H01R 13/514* (2013.01); *H01R 13/5213* (2013.01); *H01R 24/78* (2013.01); *H01R 2103/00* (2013.01)

(58) Field of Classification Search
CPC ..... H01R 13/5202; H01R 13/514; H01R 13/5213
USPC ..... 439/587
See application file for complete search history.

(56) References Cited

U.S. PATENT DOCUMENTS 3,140,344 A * 7/1964 Slater ..... H01R 13/447 174/67
5,542,852 A * 8/1996 Hsueh ..... H01R 13/447 174/67
5,856,633 A * 1/1999 Zelkovsky ..... H01R 13/4532 174/67
6,530,786 B2 * 3/2003 Ishikawa ..... H01R 12/79 439/79
6,786,753 B1 * 9/2004 Lai ..... H01R 13/6392 439/270
6,896,529 B2 * 5/2005 Jing ..... H01R 13/6275 439/135
7,938,676 B1 * 5/2011 Patel ..... H01R 25/006 439/489
8,480,420 B2 * 7/2013 Ziobro ..... F21S 6/003 439/214
8,668,512 B2 * 3/2014 Chang ..... H01R 24/78 439/304
8,753,134 B1 * 6/2014 Lai ..... H01R 25/006 439/131
9,029,738 B2 * 5/2015 Redl ..... A47J 41/0038 219/387
9,343,838 B2 * 5/2016 Jove Albos ..... H01R 43/18
9,431,763 B2 * 8/2016 Chapel ..... H01R 13/187
9,450,365 B1 * 9/2016 Baldwin ..... H01R 35/04
9,478,998 B1 * 10/2016 Lapetina ..... H01R 24/62
9,692,189 B2 * 6/2017 Lin ..... H01R 13/703
9,929,510 B2 * 3/2018 Vass ..... H01R 13/6395
(Continued)

*Primary Examiner* — Alexander Gilman
(74) *Attorney, Agent, or Firm* — WPAT, PC

(57) ABSTRACT

An outdoor waterproof power socket is disclosed, comprising a socket assembly and a sealing assembly, wherein the socket assembly includes a case, in which one side of the case is openly configured with a plurality of outer socket holes, while the other side of the case is also openly configured with a plurality of inner socket holes, each of the outer socket holes and each of the inner socket holes are commutative within the case, a conductive component is respectively installed within each inner socket hole; in addition, the sealing assembly includes an insulating flake and a sealing cover, in which the insulating flake is fixedly installed on one side of the case and covers each inner socket hole, and the sealing cover completely wraps the insulating flake as well as the position where the case and the insulating flake connect.

6 Claims, 8 Drawing Sheets

(56) References Cited

U.S. PATENT DOCUMENTS

| | | | | |
|---|---|---|---|---|
| 10,424,863 | B1 * | 9/2019 | Zhuang | H01R 13/4536 |
| 10,468,806 | B2 * | 11/2019 | Zhu | H01R 13/631 |
| 10,630,017 | B2 * | 4/2020 | Zhou | H01R 13/44 |
| 2010/0130053 | A1 * | 5/2010 | Ziobro | F21V 33/006 439/404 |
| 2013/0309900 | A1 * | 11/2013 | Ramsier | H01R 13/447 439/488 |
| 2017/0352978 | A1 * | 12/2017 | Mortun | H01R 13/14 |
| 2017/0358886 | A1 * | 12/2017 | Scanzillo | H01R 13/4534 |
| 2018/0090870 | A1 * | 3/2018 | Naaman | H01R 31/06 |

* cited by examiner

OUTDOOR WATERPROOF POWER SOCKET

BACKGROUND OF THE INVENTION

1. Field of the Invention

The present invention relates to an outdoor waterproof power socket, which is a socket structure for connecting a plug to provide electric power, and the socket structure is particularly suitable for outdoor use and enables a good waterproof effect.

2. Description of Related Art

Since human beings have known the use of electricity, the development of science and technology and industry has made rapid and significant progresses, and the impact of electric energy and electrical appliances has greatly affected life. Human life at modern days is closely connected with electric energy and electrical appliances, and there is a need all the time for electrical appliances both indoors and outdoors. The sockets used outdoors are easily affected by the weather, such as rain, fog, etc., and in case that the water vapor or moisture inadvertently enters into the socket, it is easy to cause a short circuit, possibly further resulting in disastrous accidents.

Conventional outdoor sockets are typically provided with a switchable waterproof cover outside the socket hole, but such a structural design is not a cure for thoroughly solving this issue. In fact, when there is excessive amount of water vapor existing in the air, this kind of waterproof masks may be still unable to enable the intended blockage effect, or even the moisture in the socket will adversely increase thus possibly causing the short circuit problem. In addition, this sort of waterproof masks mostly are manually controlled, and human errors may be quite frequently occur, e.g., people perhaps forgot to close the waterproof mask, thus leading to short circuit accidents.

Therefore, the solution provided by the outdoor waterproof power socket according to the present invention aims to improve and enhance the structural sealing resistance of the socket case, and to allow a larger air pressure to be formed inside the socket case, thereby generating a pressure difference against the outside so as to effectively prevent external moisture from entering the socket.

SUMMARY OF THE INVENTION

The outdoor waterproof power socket according to the present invention comprises a socket assembly and a sealing assembly, wherein the socket assembly includes a case, in which one side of the case is openly configured with a plurality of outer socket holes, while the other side of the case opposite to the outer socket holes is also openly configured with a plurality of inner socket holes, each of the outer socket holes and each of the inner socket holes are commutative within the case, the hole diameter of each inner socket hole is larger than the hole diameter of each outer socket hole, a conductive component is respectively installed within each inner socket hole, and an electrical connection end extends from one end of each conductive component; in addition, the sealing assembly includes an insulating flake and a sealing cover, in which the insulating flake is fixedly installed on one side of the case and covers each inner socket hole, and the sealing cover completely wraps the insulating flake as well as the position where the case and the insulating flake connect, and lets the electrical connection end expose, such that the insulating flake and the sealing cover can completely close all openings, orifices or seams except the outer socket holes thereby making the internal pressure of the case become greater than the external pressure, so the pressure difference created therein can effectively prevent external water from entering in order to achieve a good water blocking effect.

More specifically, the number of the outer socket holes is three, i.e., respectively an earth wire hole, a live wire hole and a neutral wire hole, with three inner socket holes and three conductive components being respectively and correspondingly configured.

More specifically, the sealing cover is manufactured by means of injection molding processes.

More specifically, a film is installed between the insulating flake and the case.

More specifically, plural cases can be simultaneously installed, with an electrical connection end respectively extending from the two sides of each conductive component, and one side of each case is fixedly configured with a insulating flake covering each inner socket hole, and the sealing cover conjunctively and completely wraps and fixes each insulating flake as well as the position where each case and each insulating flake connect, and lets each electrical connection end expose, such that each of the cases can achieve the parallel connection through the mutual electrical connection of each of the electrical connection ends.

DETAILED DESCRIPTION OF THE PREFERRED EMBODIMENTS

Figure 1:
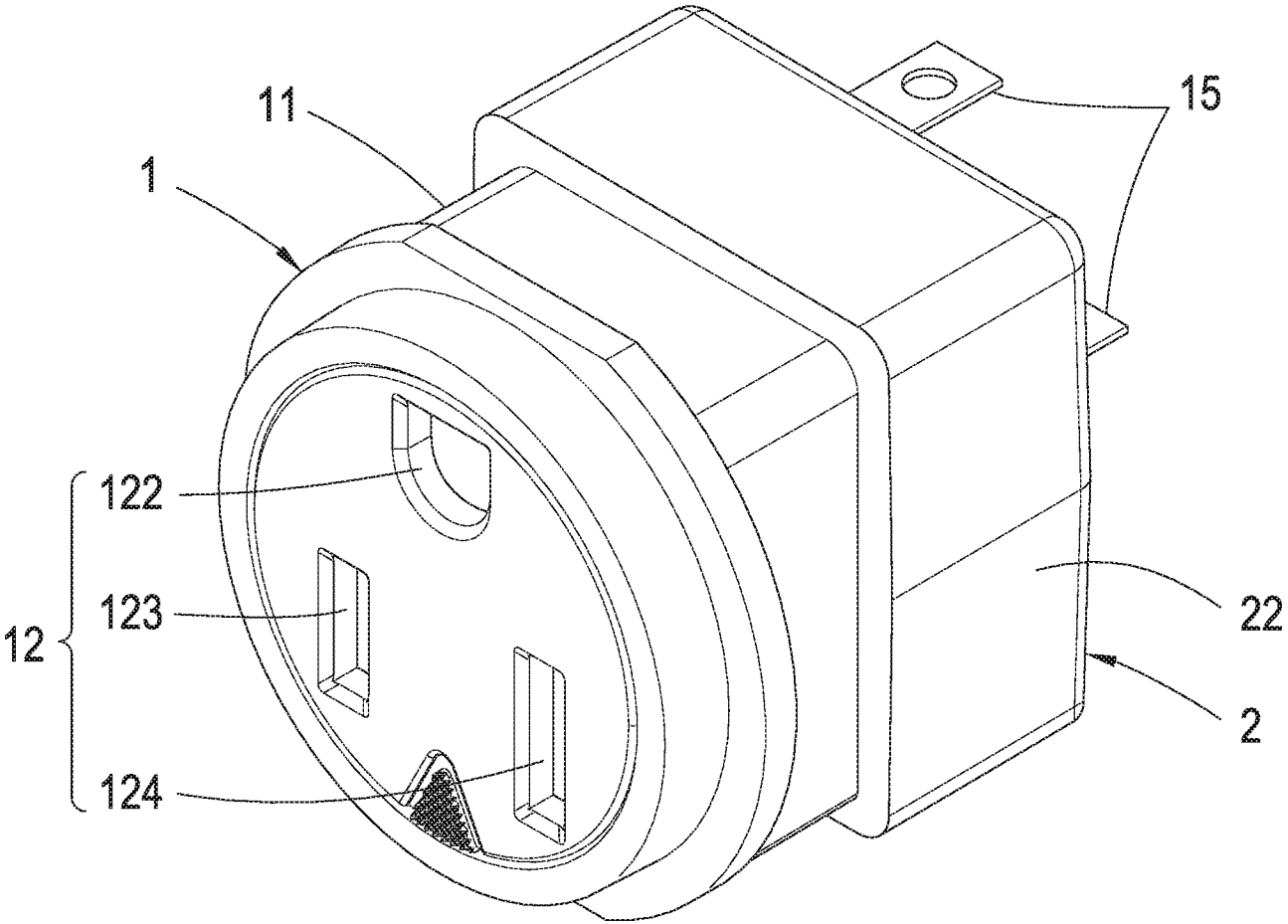
FIG. 1 shows a post-assembly stereo view for a first embodiment of the outdoor waterproof power socket according to the present invention.
Figure 2:
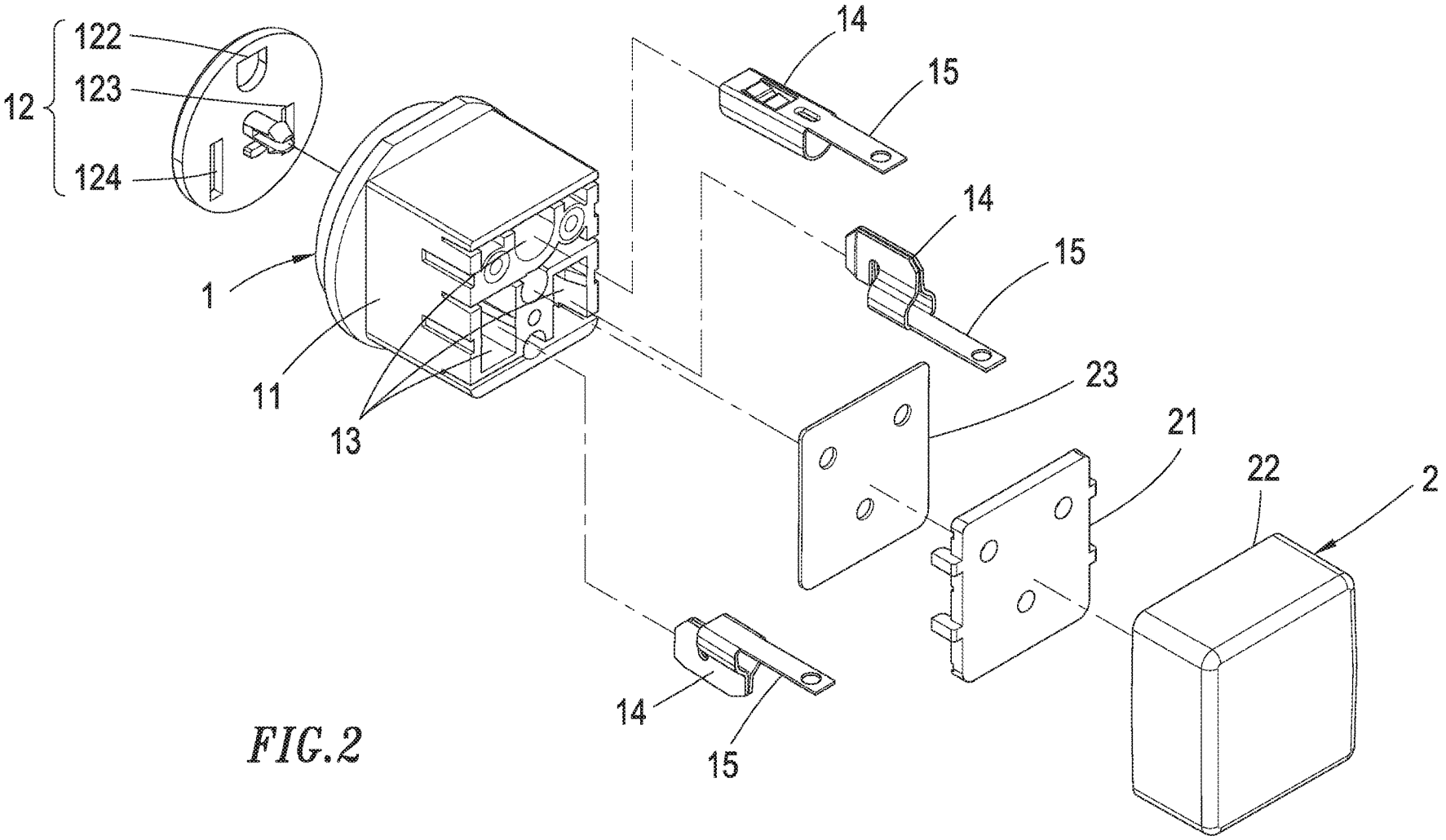
FIG. 2 shows a pre-assembly stereo view for the first embodiment of the outdoor waterproof power socket according to the present invention.
Figure 3:
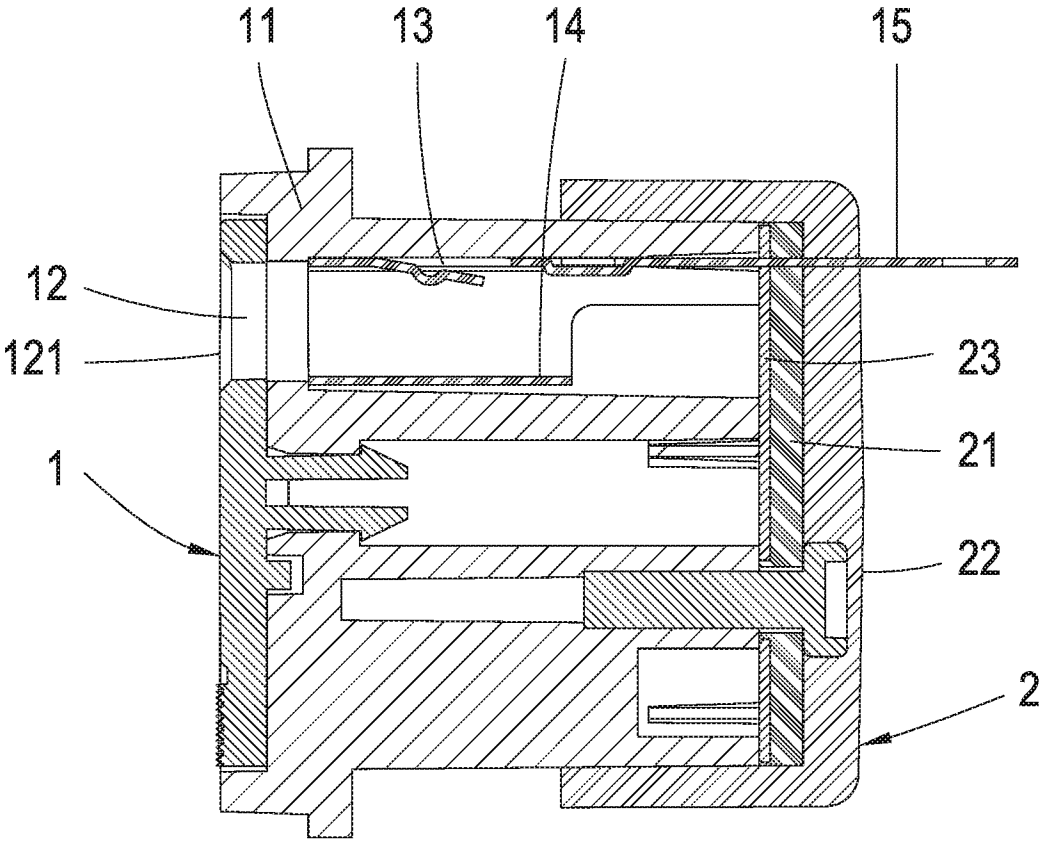
FIG. 3 shows a cross-sectioned view for the first embodiment of the outdoor waterproof power socket according to the present invention.
Figure 4:
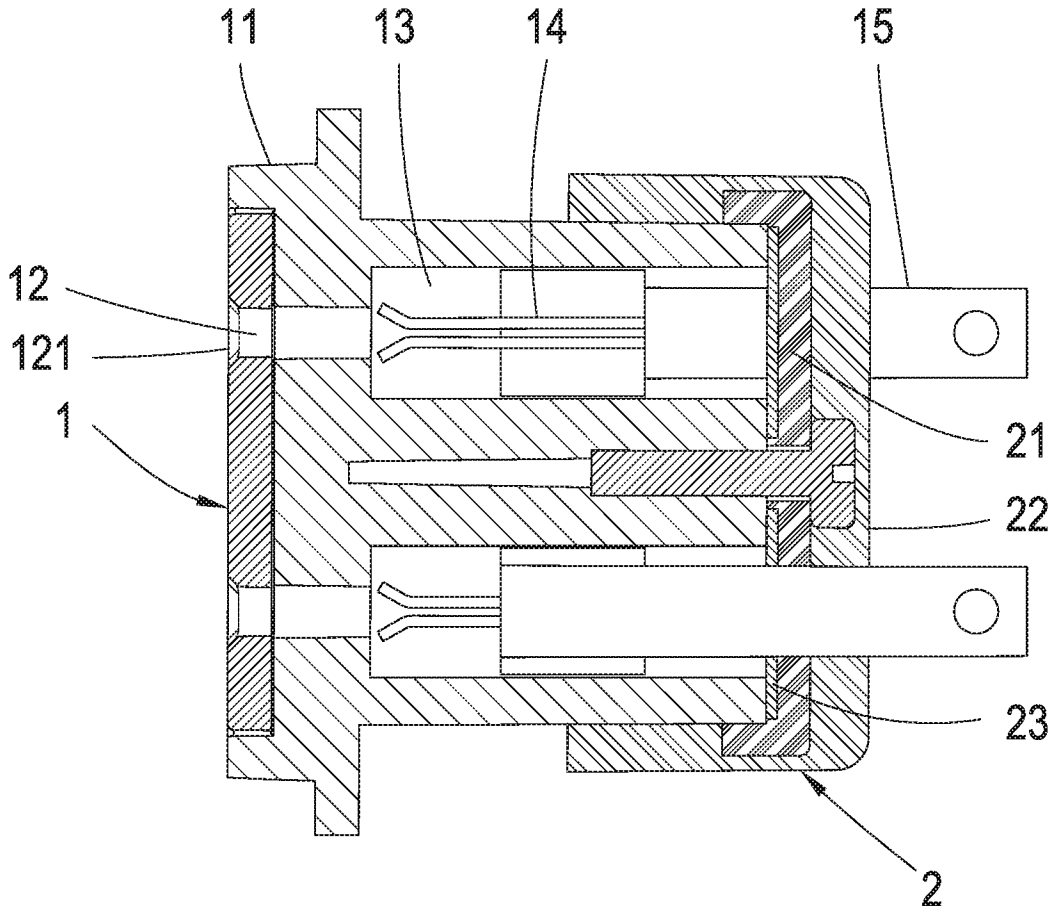
FIG. 4 shows a cross-sectioned view from another perspective for the first embodiment of the outdoor waterproof power socket according to the present invention.

Other technical contents, aspects and effects in relation to the present invention can be clearly appreciated through the detailed descriptions concerning the preferred embodiments of the present invention in conjunction with the appended drawings.

Refer initially to FIGS. 1-4, wherein stereo views and internal structural cross-sectioned views from different perspectives for a first embodiment of the outdoor waterproof power socket according to the present invention are respectively shown. As described in the Figures, it comprises a socket assembly 1 and a sealing assembly 2.

Herein it can be observed that the socket assembly 1 includes a case 11, in which one side of the case 11 is openly configured with a plurality of outer socket holes 12, while the other side of the case 11 opposite to the outer socket holes 12 is also openly configured with a plurality of inner socket holes 13, each of the outer socket holes 12 and each of the inner socket holes 13 are commutative within the case 11, and the hole diameter of each inner socket hole 13 is larger than the hole diameter of each outer socket hole 12, and a conductive component 14 is respectively installed within each inner socket hole 13, and an electrical connection end 15 extends from one end of each conductive component 14; besides, in the present embodiment, the number of the outer socket holes 12 is three, i.e., respectively an earth wire hole 122, a live wire hole 123 and a neutral wire hole 124, with three inner socket holes 13 and three conductive components 14 being respectively and correspondingly configured.

Moreover, the sealing assembly 2 includes an insulating flake 21 and a sealing cover 22, in which the insulating flake 21 is fixedly installed on one side of the case 11 and covers each inner socket hole 13, and the sealing cover 22, by means of the injection molding manufacture processes, completely wraps the insulating flake 21 as well as the position where the case 11 and the insulating flake 21 connect, and lets the electrical connection end 15 expose.

Figure 5:
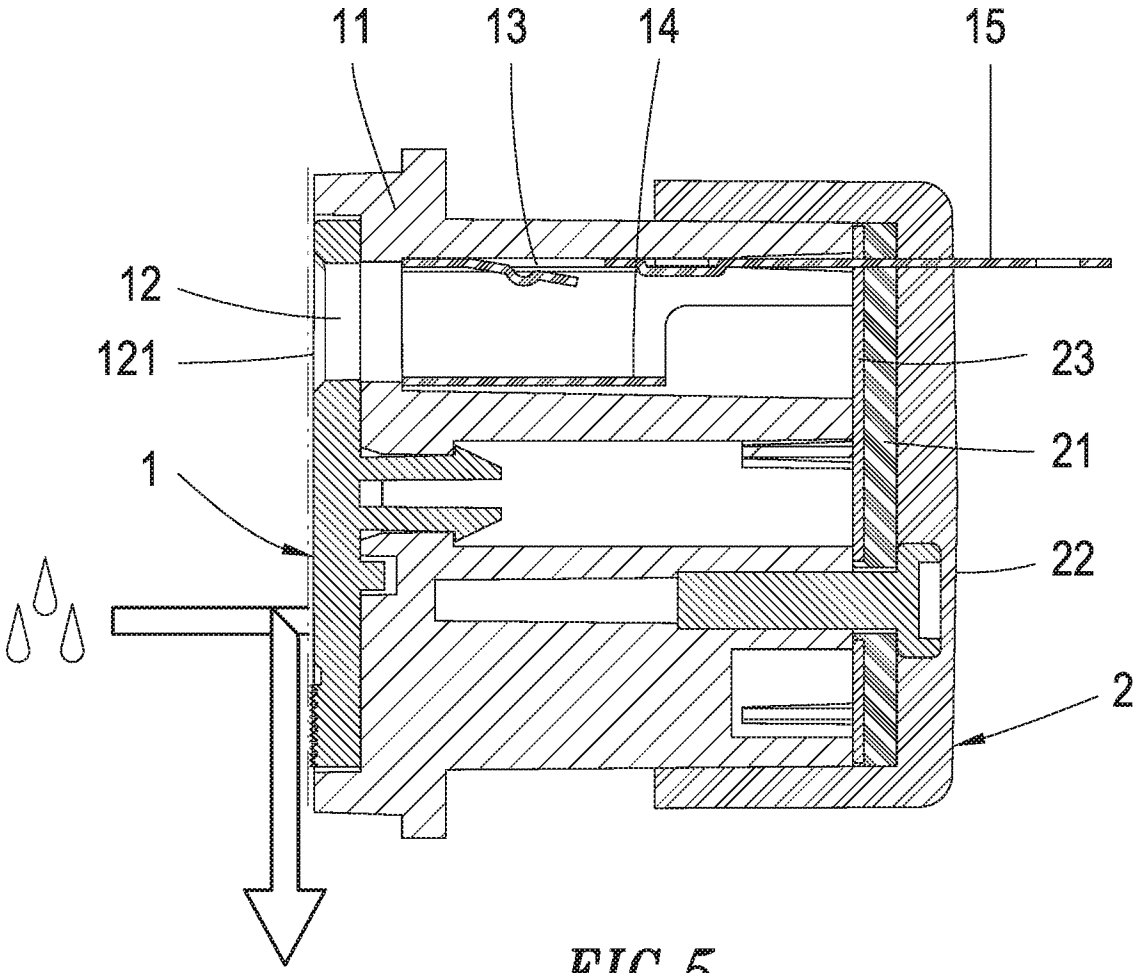
FIG. 5 shows a cross-sectioned view in practice for the first embodiment of the outdoor waterproof power socket according to the present invention.

Subsequently, refer to FIG. 5, wherein the outdoor waterproof power socket according to the present invention is shown, and it can be seen that the insulating flake 21 and the sealing cover 22 together provide a kind of double envelope which completely closes all the orifices, holes or seams except the outer socket holes 12, and causes the internal pressure of each of the outer socket holes 12 and the inner socket holes 13 to become greater than the external pressure outside the casing 11, so that the created pressure difference can form a surface tension at the opening 121 of each outer socket hole 12 in order to effectively prevent external substances from entering the case 11; accordingly, upon being used outdoors, it is possible to prevent rain or moisture from entering the case and to avoid short circuit accidents.

Moreover, refer next to FIGS. 1-4, wherein the illustrated outdoor waterproof power socket according to the present invention shows that a film 23 can be additionally installed between the insulating flake 21 and the case 11, which can further enhance the sealing effect inside the case 11.

Figure 6:
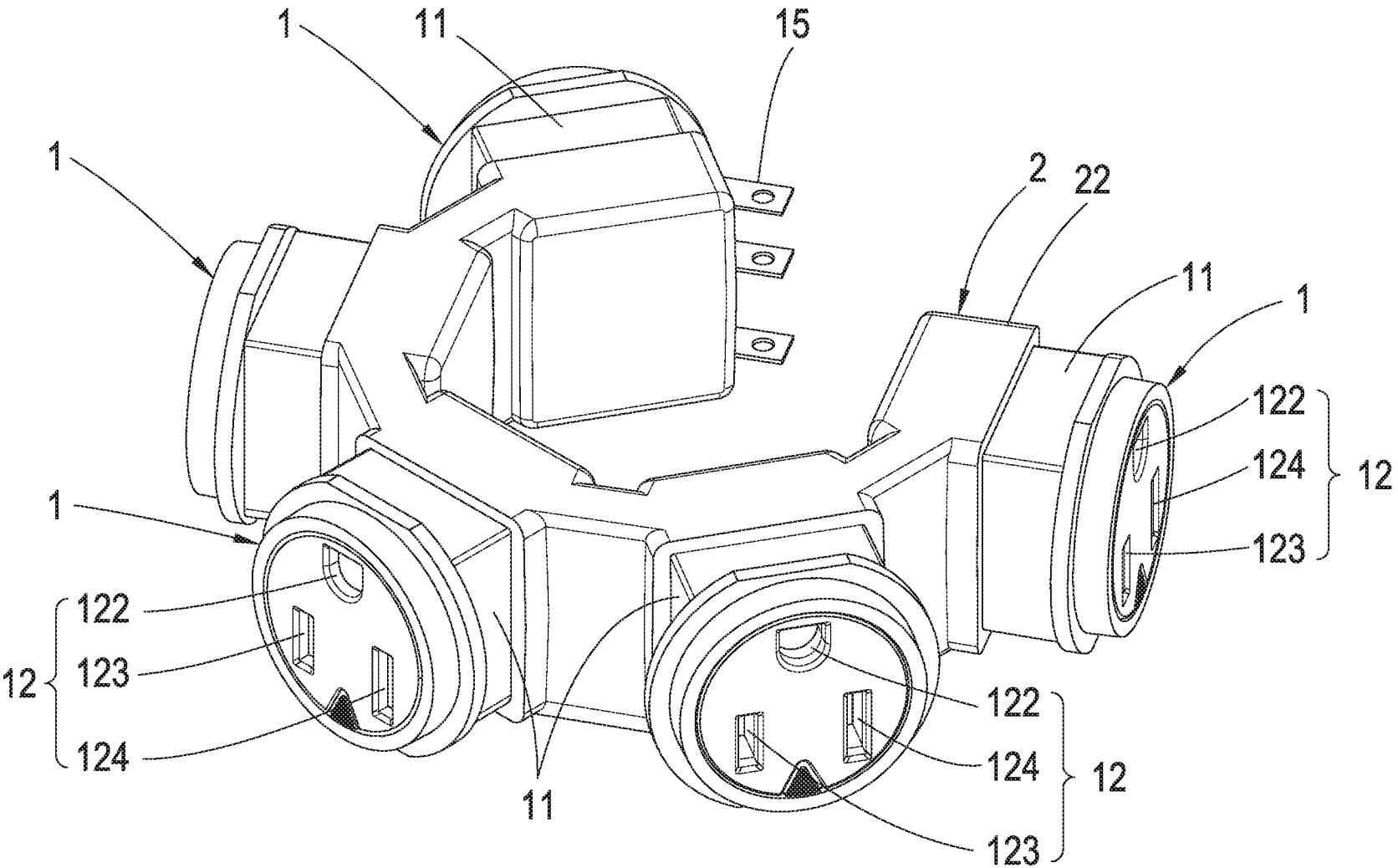
FIG. 6 shows a post-assembly stereo view for a second embodiment of the outdoor waterproof power socket according to the present invention.
Figure 7:
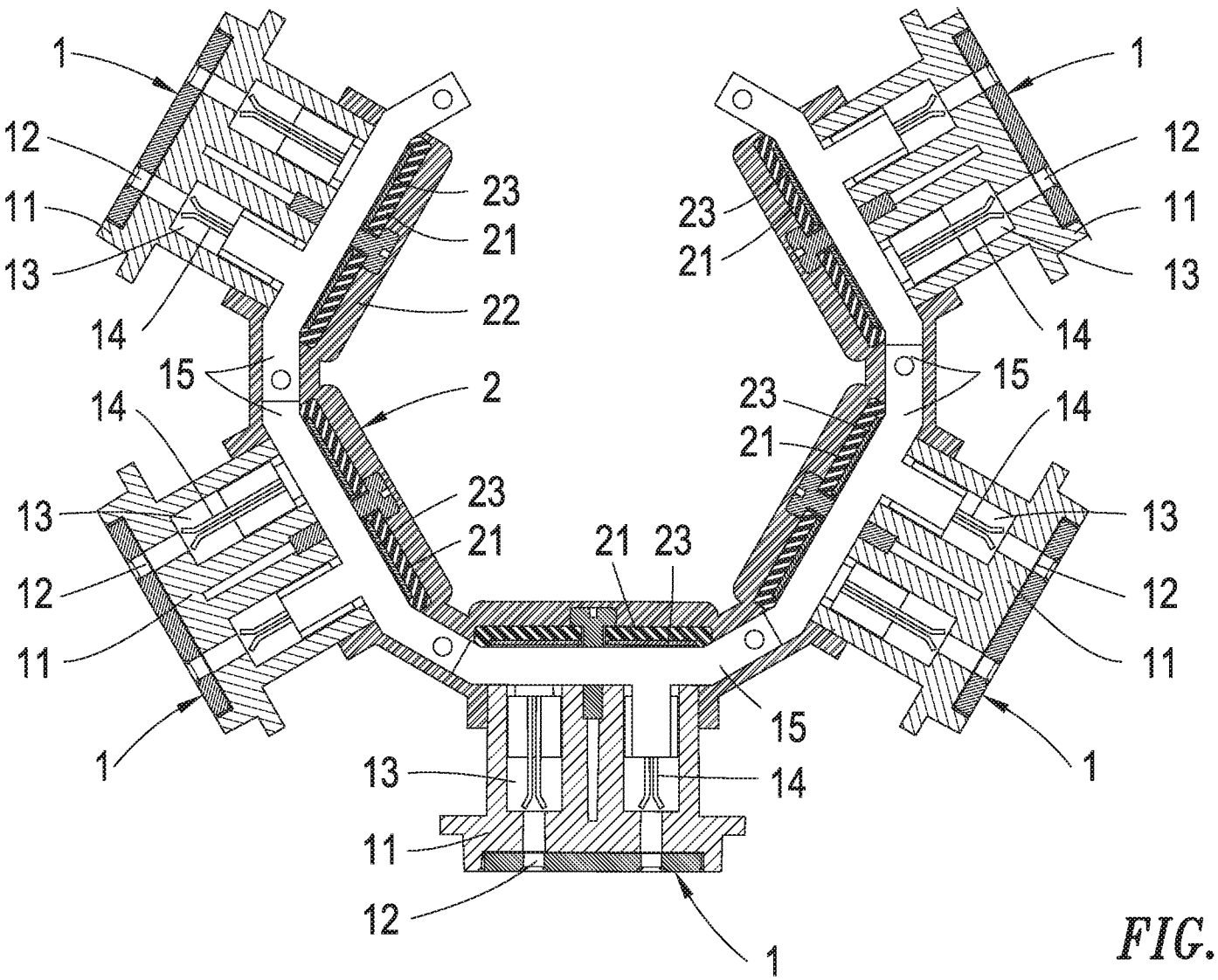
FIG. 7 shows a cross-sectioned view for the second embodiment of the outdoor waterproof power socket according to the present invention.

Refer then to FIGS. 6-7, wherein a stereo view and an internal structural cross-sectioned view for a second embodiment of the outdoor waterproof power socket according to the present invention are respectively shown. The present embodiment illustrates the configuration designed to provide multiple sockets connected in parallel, wherein a plurality of cases 11 are installed, and an electrical connection end 15 extends from the two sides of each conductive component 14 at a prescribed angle, such that each of the cases 11 can be connected in parallel through mutual electrical connections between each of the electrical connection ends 15, while one side of the each of the cases 11 is fixedly installed with the insulating flake 21 and covers each of the inner socket hole 13; in addition, the sealing cover 22 is manufactured by means of injection molding processes and conjunctively and completely wraps and fixes each insulating flake 21 as well as the position where each case 11 and each insulating flake 21 connect, and lets each electrical connection end expose. Besides, in the present embodiment, it can observed that five cases 11 are arranged in a radial form and each of the electrical connection ends 15 is mutually connected at a prescribed angle so that a polygonal shape can be created after completing the connection process, and the sealing cover 22 is also designed to be polygonal in accordance with the radial arrangement of such cases 11.

Figure 8:
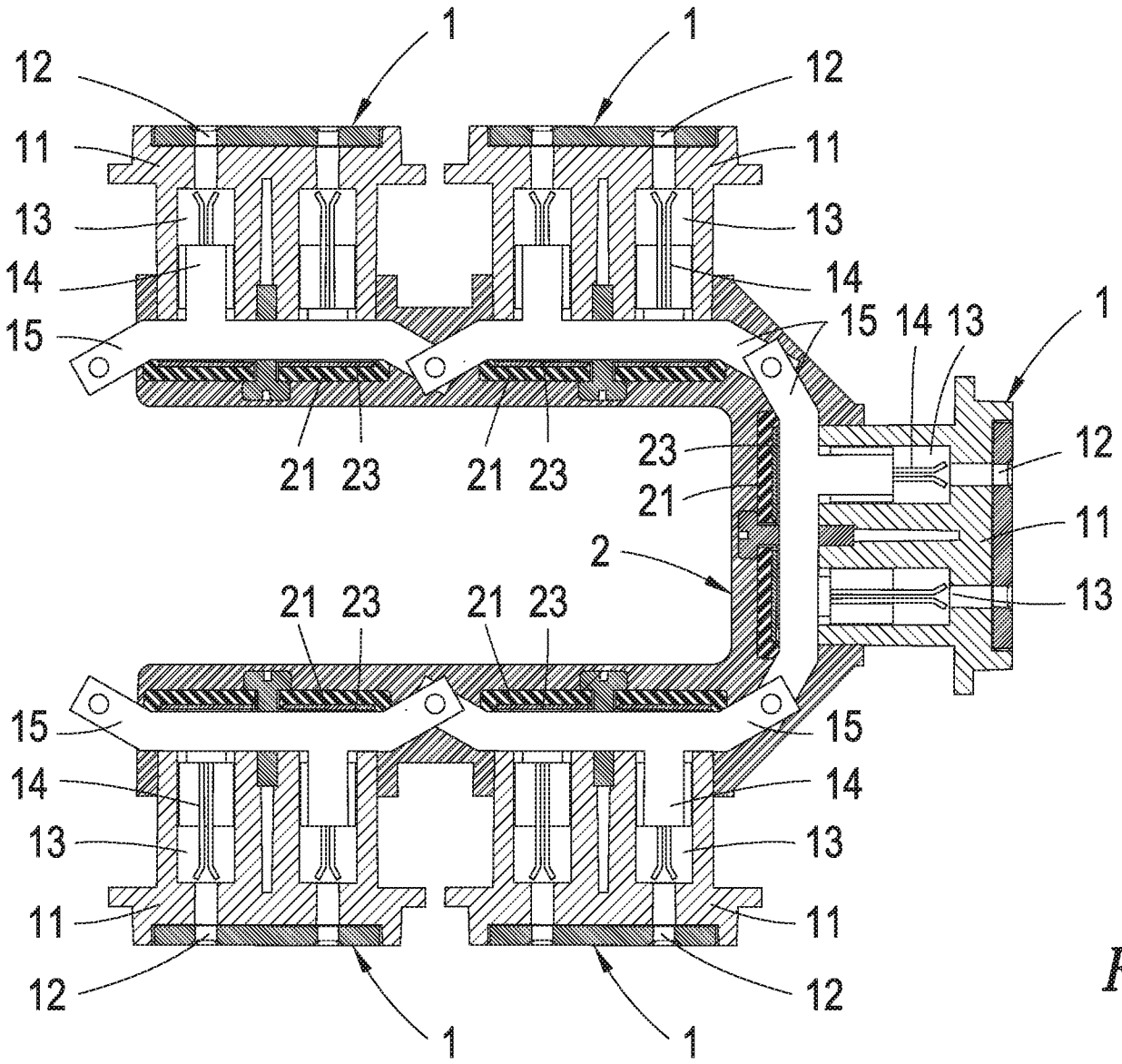
FIG. 8 shows a cross-sectioned view for a third embodiment of the outdoor waterproof power socket according to the present invention.

Refer next to FIG. 8, wherein an internal structural cross-sectioned view for a third embodiment of the outdoor waterproof power socket according to the present invention is shown. Similarly, this embodiment also illustrates the configuration designed to provide multiple sockets connected in parallel. Furthermore, in this embodiment, it can observed that five cases 11 are arranged in a matrix form, and the sealing cover 22 is designed to be rectangular in accordance with the arrangement of the cases 11.

In comparison with other conventional technologies, the outdoor waterproof power socket according to the present invention provides the following advantages:

1. Through the structural matching, assembly and formation processes, under the specific sealing condition, the inner socket hole for conductively connecting to the socket inside the case autonomously forms a space having a larger pressure; therefore, under the condition that the structure is not to be damaged, the pressure difference between the inside and the outside of the case allows the case to maintain a water-blocking effect continuously without additional manual operations, and also completely avoids the possibility of operation errors, thus enabling significant convenience and practical value.

2. The machining and molding processes of the characteristic structure according to the present invention are inexpensive in terms of costs, and the manufacture operations thereof can be completed quickly, thereby facilitating competitive production efficiency.

The previously disclosed embodiments are merely illustrative of some preferred ones of the present invention, which are not intended to limit the scope thereof; those who are skilled in the relevant technical fields can, after understanding the technical features and embodiments of the present invention as explained hereinabove, certainly make equivalent changes, alterations or modifications without departing from the spirit and scope of the present invention, which are nonetheless deemed as falling within the coverage of the present invention; accordingly, the scope of the present invention to be protected by patent laws is subject to the definition of the claims attached to this specification.

What is claimed is:

1. An outdoor waterproof power socket system, comprising:

a socket assembly, including a case, in which one side of the case is openly configured with a plurality of outer socket holes, while the other side of the case opposite to the outer socket holes is also openly configured with a plurality of inner socket holes, each of the outer socket holes and each of the inner socket holes are commutative within the case, the hole diameter of each inner socket hole is larger than the hole diameter of each outer socket hole, a conductive component is respectively installed within each inner socket hole, and an electrical connection end extends from one end of each conductive component; and a sealing assembly, including an insulating flake and a sealing cover, in which the insulating flake is fixedly installed on one side of the case and covers each inner socket hole, and the sealing cover completely wraps the insulating flake as well as the position where the case and the insulating flake connect and let the electrical connection end expose;

wherein plural cases can be simultaneously installed, with an electrical connection end respectively extending from the two sides of each conductive component, such that each of the cases can achieve the parallel connection through the mutual electrical connection of each of the electrical connection ends; and wherein each of the electrical connection ends extends respectively towards its both two sides at a prescribed angle, and these cases are arranged in a radial form such that they can be connected at each of the electrical connection ends with a prescribed angle in order to constitute a polygonal shape, and the sealing cover is designed to be polygonal in accordance with the case arrangement.

2. The outdoor waterproof power socket system according to claim 1, wherein the number of the outer socket holes is three, i.e., respectively an earth wire hole, a live wire hole and a neutral wire hole, with three inner socket holes and three conductive components being respectively and correspondingly configured.

3. The outdoor waterproof power socket system according to claim 1, wherein the sealing cover is manufactured by means of injection molding processes.

4. The outdoor waterproof power socket system according to claim 1, wherein a film is installed between the insulating flake and the case.

5. The outdoor waterproof power socket system according to claim 1, wherein one side of each case is fixedly configured with a insulating flake which covers each inner socket hole, and the sealing cover conjunctively and completely wraps and fixes each insulating flake as well as the position where each case and each insulating flake connect, and lets each electrical connection end expose.

6. The outdoor waterproof power socket system according to claim 1, wherein the cases are arranged in a matrix form, and the sealing cover is designed to be rectangular in accordance with the case arrangement.

* * * * *